US005713568A

United States Patent [19]

Tamehira

[11] Patent Number: 5,713,568

[45] Date of Patent: Feb. 3, 1998

[54] PAPER FEEDING APPARATUS

[75] Inventor: Masato Tamehira, Nara, Japan

[73] Assignee: Sharp Kabushiki Kaisha, Osaka, Japan

[21] Appl. No.: 576,895

[22] Filed: Dec. 22, 1995

[30] Foreign Application Priority Data

Dec. 27, 1994 [JP] Japan ..... 6-325034

[51] Int. Cl.[6] ..... B65H 3/06

[52] U.S. Cl. ..... 271/117; 271/127; 271/157

[58] Field of Search ..... 271/127, 157, 271/117

[56] References Cited

U.S. PATENT DOCUMENTS 5,096,182 3/1992 Kashimura .
5,564,690 10/1996 Oshida ..... 271/127 X
5,573,235 11/1996 Asai ..... 271/127 X

FOREIGN PATENT DOCUMENTS 464815 1/1992 European Pat. Off. .
2-99365 4/1990 Japan .
4-135528 12/1992 Japan .
5-97256 4/1993 Japan .

*Primary Examiner*—David H. Bollinger

[57] ABSTRACT

A paper feeding apparatus of simple structure which enables supply of paper onto a paper feeding tray and replacement of the paper thereon with an excellent operability. The paper feeding tray is rotated to be engaged with a locking piece of an engaging member and held at a standby position. At this position, the paper feeding tray presses the locking piece, while the engaging member rotates around a supporting shaft and a disengaging piece moves onto the rotational track of a disengaging element. After supplying paper onto the paper feeding tray or replacing the paper thereon, when a roller drive gear of the paper feeding roller rotates, the disengaging element presses the disengaging piece, the engaging member moves in the axial direction, the locking piece withdraws, and the locking piece is disengaged from the paper feeding tray, thereby returning the paper feeding tray to a paper feeding position.

7 Claims, 10 Drawing Sheets

PAPER FEEDING APPARATUS

BACKGROUND OF THE INVENTION

1. Field of the Invention

The present invention relates to a paper feeding apparatus for use in a laser printer, an ink-jet printer, a copying machine, a plain-paper facsimile, or the like.

2. Description of the Related Art

As a mechanism for separating paper from a paper feeding roller or the like, onto which the paper has been pressed, in order to supply paper onto a paper feeding tray or replace the paper on the paper feeding tray in a conventional paper feeding apparatus, Japanese Unexamined Patent Publication JPA 5-97256(1993) discloses one in which a release lever is manually operated to actuate a pressing plate for pressing paper onto a paper feeding roller. Such a mechanism requires the manual operation of the lever for separating and pressing the paper from and onto the paper feeding roller before and after the supply or replacement of the paper, resulting in an intricate operation. Moreover, the lever or the like to be operated by a user should be considerably large in size. Furthermore, a protecting mechanism for halting the feeding paper operation is also needed in case the user forgets to perform the operation of the lever or the like for pressing the paper onto the paper feeding roller after the operation of supplying or replacing paper (i.e., in case the user performs a misoperation). As a result, the component count of the apparatus is increased, which incurs the lowering of reliability, the upsizing of the apparatus, and an increase in manufacturing cost.

On the other hand, Japanese Unexamined Patent Publication JPA 2-99365(1990) discloses a mechanism in which a cam pressed onto a paper feeding tray is provided at an end of a roller shaft of a separating roller such that the paper feeding tray is moved vertically on each feeding of paper by the rotation of the cam resulting from the rotation of the separating roller, thereby automatically separating and pressing the paper from and onto the separating roller. With the mechanism, the operation of supplying or replacing paper can be performed by automatically separating the paper from the separating roller and, after the operation, the paper can be fed by automatically pressing the paper onto the separating roller.

The Japanese Unexamined Utility Model Publication JP-U-4-135528(1992) also discloses a mechanism having a drive motor for driving a paper feeding roller which can be rotated in both the forward and backward directions. When the drive motor is rotated in the backward direction, the feeding of paper by the paper feeding roller is halted, while a paper feeding gear is also rotated in the backward direction so as to press down a release lever by means of a roller provided on the paper feeding gear, thereby pressing down a paper platen and automatically releasing the pressing of paper onto the paper feeding roller. After the operation of supplying or replacing paper, the drive motor is rotated in the forward direction so as to release the pressing down of the release lever by the roller of the paper feeding gear, thereby vertically moving the paper platen and automatically pressing the paper onto the paper feeding roller.

However, in the mechanism disclosed in Japanese Unexamined Patent Publication JPA 2-99365(1990), the paper feeding tray moves vertically on each supply of paper, which causes a flapping noise. Moreover, the variation in load repeatedly occurring in the cam and a cam receiver exerts a great influence on the drive motor. Furthermore, sufficient consideration must be given to the abrasion resistance of the cam and cam receiver.

In the mechanism disclosed in Japanese Unexamined Patent Publication JPA 4-135528(1992), the drive motor for driving the paper feeding roller is rotated in the forward and backward directions. Consequently, a separate motor dedicated to paper feeding should be provided in addition to the drive motor associated with a printing process in consideration of the influence exerted on the process. Since the timing with which the paper is sent out depends on the position of the roller, a paper stopping roller and a control mechanism thereof should be provided downstream of the paper feeding roller in order to adjust timing. Moreover, each of the paper feeding roller and the paper stopping roller requires a unidirectional clutch in order to feed paper only when the paper feeding roller is rotated in the forward direction, resulting in a complicated structure, a high component count, and intricate control. Furthermore, since the release lever is in a position which can be pressed onto the roller in feeding paper, the roller periodically flicks off the release lever with the rotation of the paper feeding gear, resulting in noises (bumping sound), abrasion of the roller and release lever, and loss in torque. In addition, since the release lever can be pressed down by the roller only at limited positions (there are some peculiar points at which the paper cannot be separated from the paper feeding roller), the positioning control becomes intricate.

SUMMARY OF THE INVENTION

Hence, an object of the present invention is to provide a paper feeding apparatus of simple structure, which enables supply of paper onto a paper feeding tray or replacement of the paper thereon with excellent operability, which does not require intricate control, and is free from noises or the like.

According to the invention, a paper feeding tray 21 is designed to be rotatable around a shaft 20 between a paper feeding position A where the paper feeding tray 21 is close to a paper feeding roller 22 and presses paper onto the paper feeding roller 22 as shown in FIGS. 1(A)–(B) and 4, and a standby position B where the paper feeding tray 21 is distant from the paper feeding roller 22 and allows the supply or replacement of paper, as shown in FIGS. 7(A)–(B) and 10. Additionally, an engaging member 30 is designed to be switchable between an engaged state in which the engaging member 30 is engaged with the paper feeding tray 21 so as to hold the paper feeding tray 21 at the standby position B and a separated state in which the engaging member 30 is apart from the paper feeding tray 21 to be disengaged from the paper feeding tray 21. The engaging member 30 can be pressed onto the paper feeding roller 22 in the engaged state. With the paper feeding roller 22 being driven, the engaging member 30 is shifted from the engaged stale to the separated state.

The engaging member 30 is provided to be rotatable around a supporting shaft 32 mounted in a main body 31 of the paper feeding apparatus and movable in the axial direction. On one side of the engaging member 30 is formed with a locking piece 34 corresponding to the paper feeding tray 21, while on the other side thereof is formed a disengaging piece 35 corresponding to the paper feeding roller 22. The paper feeding roller 22 is provided with a disengaging element 50 which presses the disengaging piece 35 in the axial direction and places the engaging member 30 in a separated state. With the paper feeding tray 21 pressing the locking piece 34 in the rotational direction by the engaging member 30 in an engaged state, the disengaging piece 35 is held at a position where the disengaging piece 35 can be pressed onto the disengaging element 50.

On the outer surface of a drive transmitting element 48 provided on an end of a roller shaft 46 of the paper feeding roller 22 is formed with a concave portion 49, in which the disengaging piece 35 of the engaging member 30 and the disengaging element 50 of the paper feeding roller 22 are arranged.

In the case of supplying paper onto the paper feeding tray 21 or replacing the paper thereon in the foregoing structure, when the paper feeding tray 21 is rotated in the V direction shown in FIG. 1(B), the lower end of the paper feeding tray 21 rotates downward and the paper feeding tray 21 moves away from the paper feeding roller 22. With the bottom surface of the paper feeding tray 21 pressed onto the locking piece 34 of the engaging member 30, the engaging member 30 moves in the axial direction (W direction) and the locking piece 34 withdraws. When the paper feeding tray 21 is rotated further downward, as shown in FIG. 7(A), the engaging member 30 moves in the axial direction (X direction) and the locking piece 34 protrudes, so that the locking piece 34 is engaged in the paper feeding tray 21 and the engaging member 30 is placed in the engaged position, while the paper feeding tray 21 is held at the standby position B. With the paper feeding tray 21 pressed onto the locking piece 34 in the rotational direction, the engaging member 30 rotates around the supporting shaft 32 (Y direction), so that the disengaging piece 35 shifts to a position where the disengaging piece 35 can be pressed onto the disengaging element 50.

After supplying paper onto the paper feeding tray 21 held at the standby position B or replacing the paper thereon, the drive transmitting element 48 of the paper feeding roller 22 rotates in response to a printing start instruction, which in turn rotates the disengaging element 50 in the concave 49. With the disengaging element 50 pressing the disengaging piece 35 in the axial direction, as shown in FIG. 8(A), the engaging member 30 moves in the axial direction (W direction), so that the locking piece 34 withdraws and the engaging member 30 is placed in the separated state. Accordingly, the locking piece 34 is disengaged from the paper feeding tray 21, which returns the paper feeding tray 21 to the paper feeding position A, so that the paper on the paper feeding tray 21 is pressed onto the paper feeding roller 22.

As is apparent from the above description of the invention, after supplying paper onto the paper feeding tray or replacing the paper thereon, the engaging member in the engaged state is automatically placed in the separated state with the drive of the paper feeding roller, thereby disengaging the engaging member from the paper feeding tray and pressing the paper on the paper feeding tray onto the paper feeding roller. This relieves a user of the trouble of pressing the paper onto the paper feeding roller after the operation of supplying or replacing paper and additionally eliminates the necessity for a protecting mechanism. As a result, there can be achieved an improved operability and a reduced component count compared with the case of manually operating a lever or the like, resulting in reducing the apparatus in size and cost.

In addition, since the engaging member in the engaged state can be pressed onto the paper feeding roller, the paper feeding roller under being driven is not pressed onto the engaging member in feeding paper with the paper feeding tray at the paper feeding position. As a result, the driving motor for driving the paper feeding roller does not undergo an influence (a loss in torque etc.), so that the noise resulting from a collision of the paper feeding roller with the engaging member in feeding paper and the abrasion thereof can be prevented.

Moreover, according to the invention, the engaging member is a single element composed of the locking piece corresponding to the paper feeding tray and the disengaging piece corresponding to the paper feeding roller, which are integrally formed. Consequently, the automatic disengaging (lock disengaging) mechanism of the paper feeding tray can be composed of a simple mechanical structure, which does not require intricate control.

Furthermore, according to the invention, the disengaging piece and the disengaging element are positioned in the concave of the drive transmitting element of the paper feeding roller, so that the necessary space on one side of the paper feeding roller can be saved, which enables apparatus miniaturization.

BRIEF DESCRIPTION OF THE DRAWINGS

Other and further objects, features, and advantages of the invention will be more explicit from the following detailed description taken with reference to the drawings wherein:

FIG. 1 are views each showing a principal portion of a paper feeding apparatus of an embodiment of the invention with an engaging member being in a normal position, of which

FIG. 6*b* is a side view taken from the direction reverse to that of the arrow R1 of FIG. 5, FIG. 6C of which is a plan view, FIG. 6D of which is a sectional view taken along a line A—A of FIG. 6A, and FIG. 6E of which is a side view taken from the direction of an arrow R2 of FIG. 5;

FIGS. 7A and 7B are views each showing the principal portion of the paper feeding apparatus with the engaging member in an engaged state, of which FIG. 7A is a partially cutaway plan view thereof and FIG. 7B is a side view thereof;

FIGS. 8A and 8B are views each showing the principal portion of the paper feeding apparatus with the engaging member in a separated state, of which FIG. 8A is a partially cutaway plan view thereof and FIG. 8B is a side view thereof;

FIGS. 9A and 9B are views each showing the principal portion of the paper feeding apparatus with the engaging member rotating around a shaft and with a disengaging piece pressed onto a disengaging element, of which FIG. 9A is a partially cutaway plan view thereof and FIG. 9B is a side view thereof.

DETAILED DESCRIPTION OF THE PREFERRED EMBODIMENTS

Figure 1A:
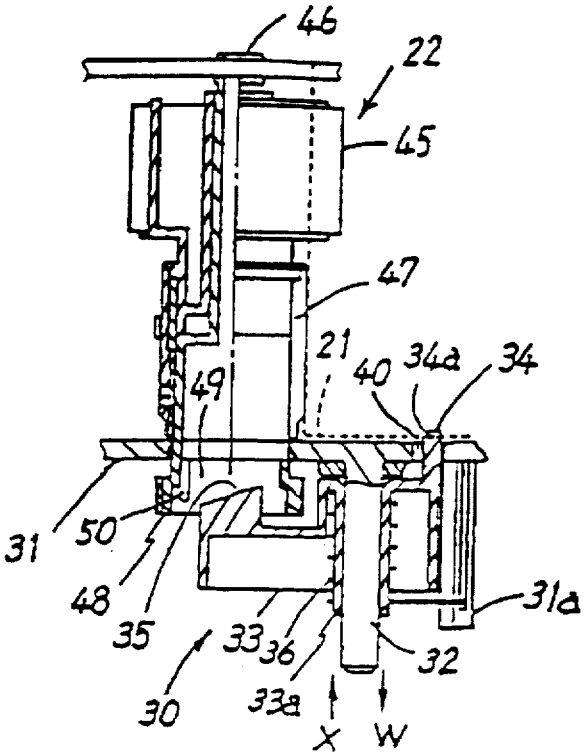
FIG. 1A is a partially cutaway plan view thereof and FIG. 1B is a side view thereof.

Now referring to the drawings, preferred embodiments of the invention are described below.

Figure 2:
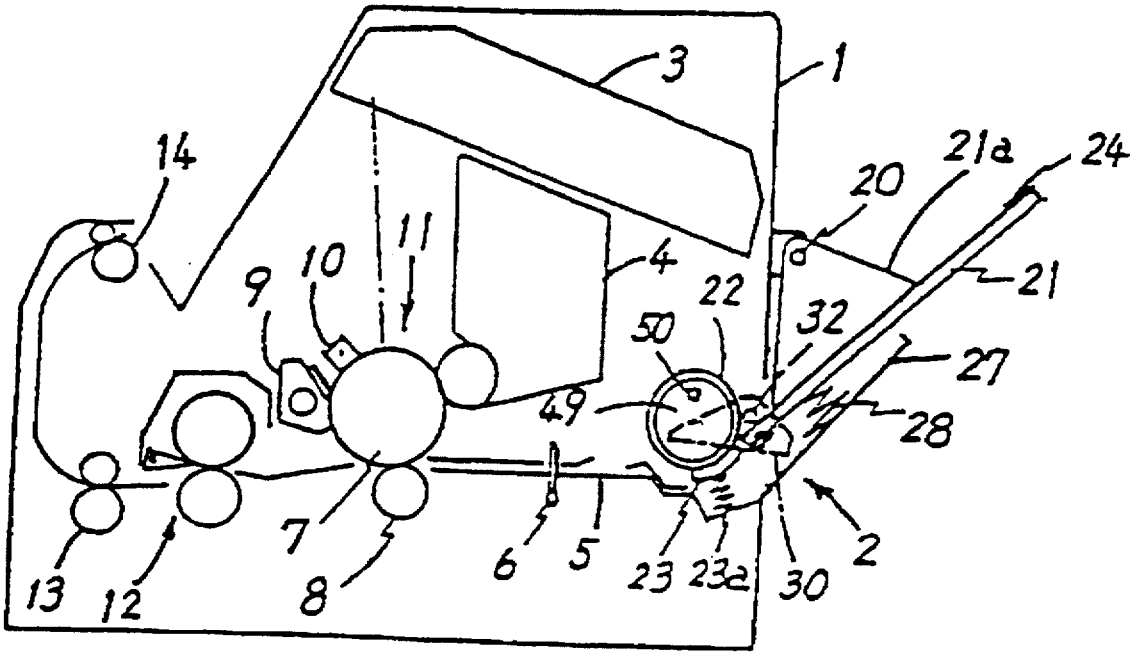
FIG. 2 is a view showing the structure of a laser printer.

FIG. 2 shows a laser printer comprising a paper feeding apparatus of a first embodiment of the present invention, in which a reference numeral 1 designates a main body of the printer, 2 designates the paper feeding apparatus, 3 designates an optical system unit, 4 designates a developing unit, 5 designates a paper conveying path, 6 designates a paper detection switch, and 7 designates a photosensitive member around which a transfer device 8, a cleaning device 9, and an electrical charging device 10 are disposed to constitute an image forming processor 11. Downstream of the photosensitive member 7 are disposed a fixing device 12, a conveying roller 13, and a paper discharging roller 14.

The laser printer is so constituted that, in response to a print instruction from a host computer (not shown), recorded information is formed into an electrostatic latent image on a surface of the photosensitive member 7 by the optical system unit 3. The electrostatic latent image is developed by the developing unit 4, resulting in a toner image, which is then transferred onto paper fed by the paper feeding apparatus 2 and then fixed thereon by the fixing device 12, followed by the discharging of the paper.

Figure 1B:
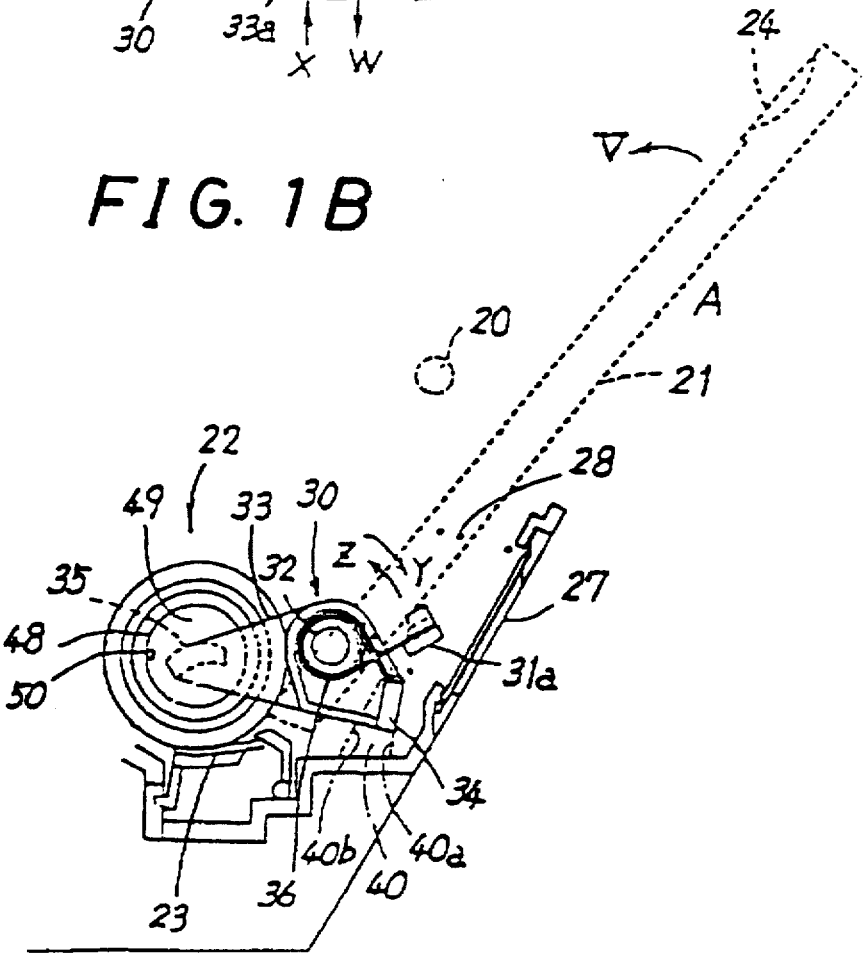

As shown in FIGS. 1(A)–(B) and 2, the paper feeding apparatus 2 comprises a paper feeding tray 21 which is rotatably supported around a transverse shaft 20 in the main body 1 of the printer, the paper feeding tray 21 on which a plurality of sheets of paper can be disposed, a paper feeding roller 22 for feeding paper onto the paper feeding tray 21, and a separating plate 23 for preventing the multifeeding of the sheets of paper pressed onto the paper feeding roller 22 by a pressing spring 23*a*.

Figure 3:
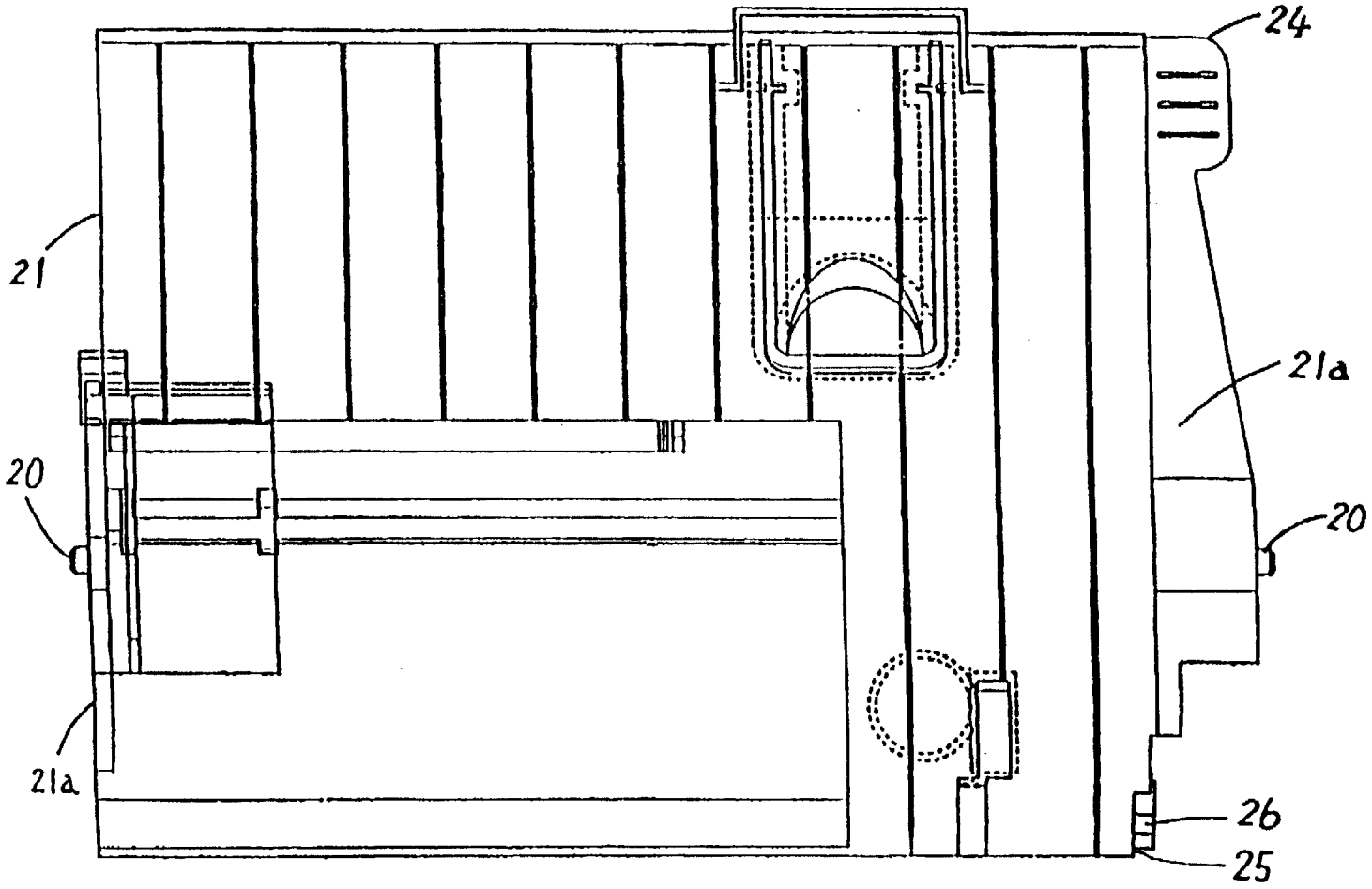
FIG. 3 is a plan view of a paper feeding tray.
Figure 4:
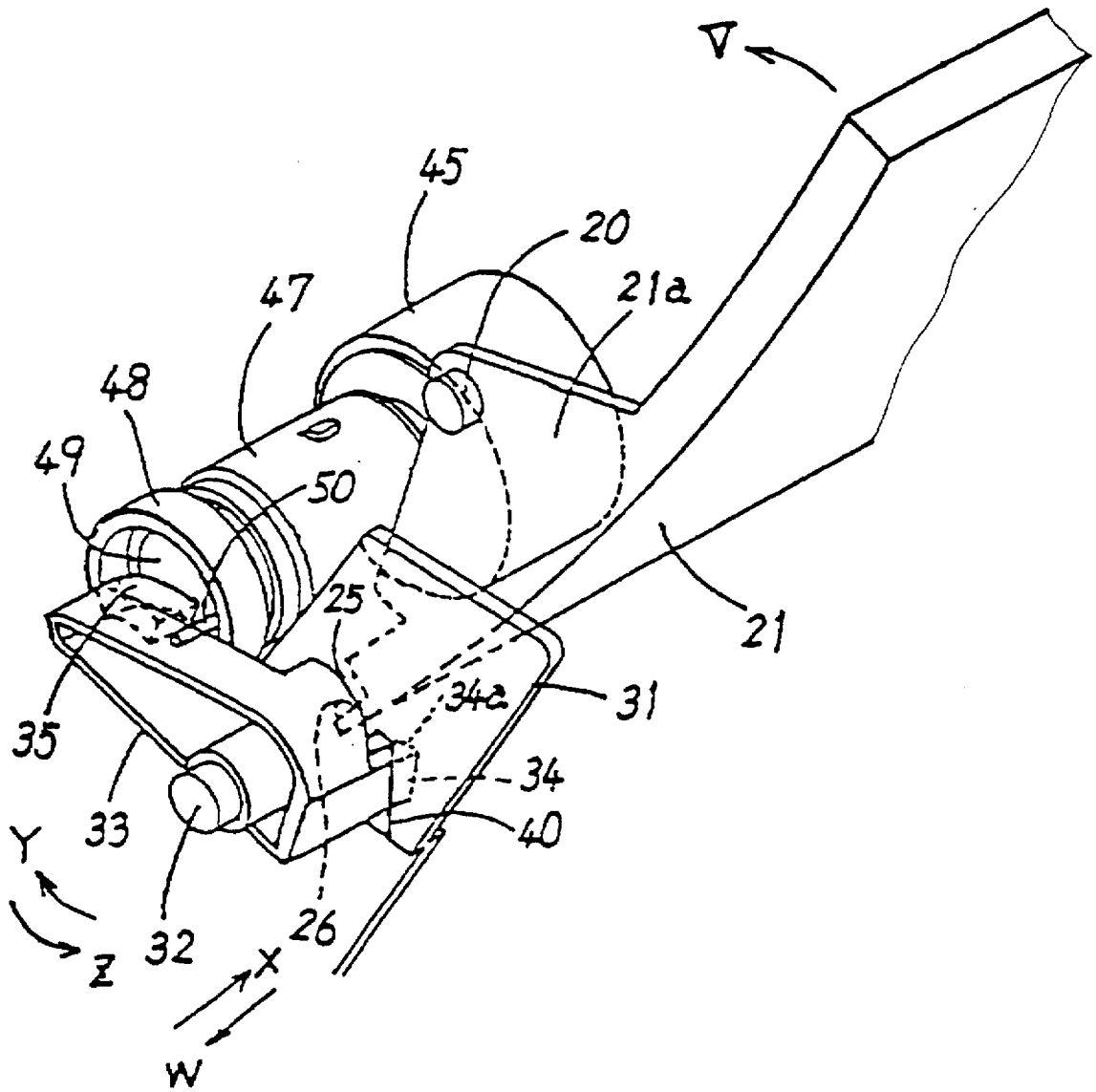
FIG. 4 is a perspective view of the principal portion of the paper feeding apparatus with the engaging member being in the normal position.
Figure 5:
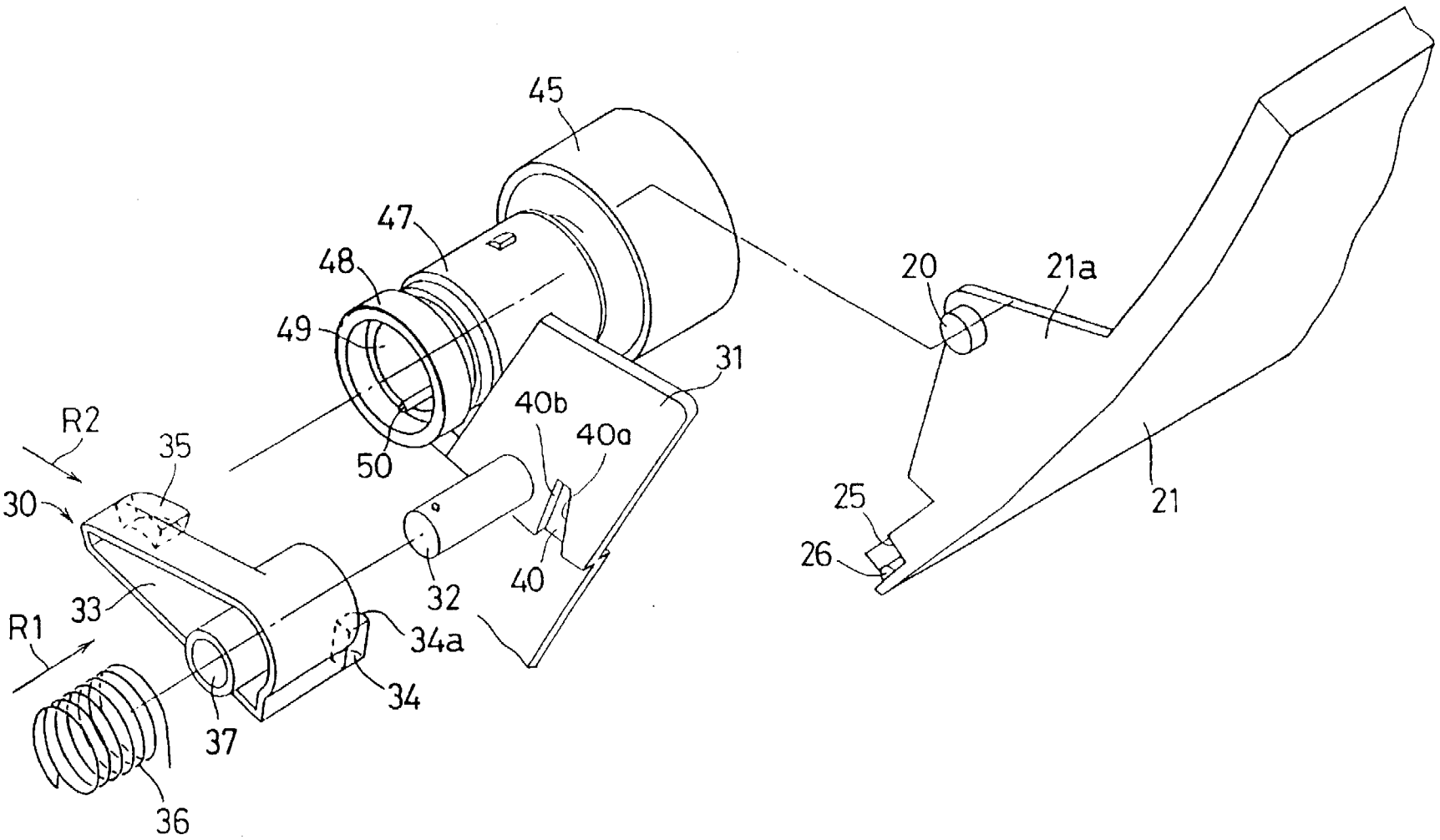
FIG. 5 is an exploded view in perspective of the paper feeding apparatus with the engaging member being in the normal position.
Figure 6A:
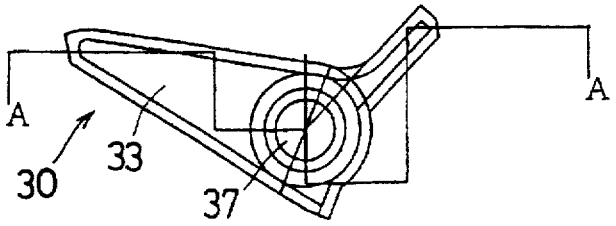
FIGS. 6A through 6E are views showing the forms of the engaging member, FIG. 6A of which is a side view taken from the direction of an arrow R1 of FIG. 5.
Figure 6B:
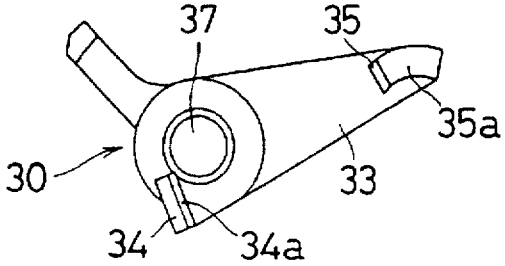
Figure 6C:
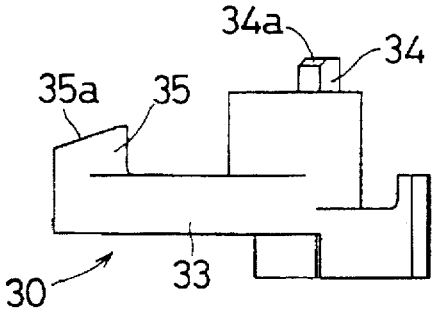
Figure 6D:
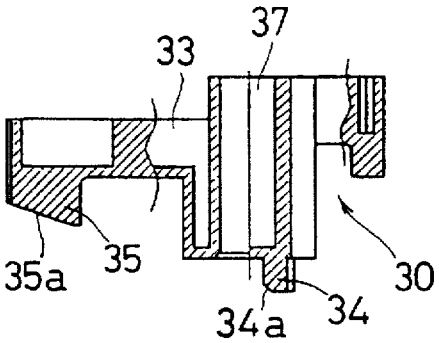
Figure 6E:
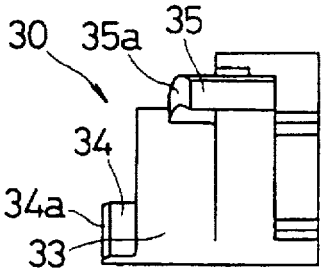

As shown in FIG. 3, the paper feeding tray 21 is in the form of a rectangular flat plate with a pair of arms 21*a* which are formed to protrude upward from the midpoints on the both sides of the paper feeding tray 21. The transverse shaft 20 is internally formed with the pair of arms 21*a*. The paper feeding tray 21 is integrally formed with a knob 24 for manually rotating the paper feeding tray 21. The knob 24 is positioned on one corner of that end (upper end) of the paper feeding tray 21 which is opposite to the paper feeding roller 22 relative to the transverse shaft 20. As shown in FIG. 4, one corner of that end (lower end) of the paper feeding tray 21 which is closer to the paper feeding roller 22 is cut out in the direction of the thickness of the paper feeding tray 21. The cutout portion 25 is integrally formed with a projection 26 for engagement to be engaged with a locking piece 34 of an engaging member which will be described below.

Figure 7A:
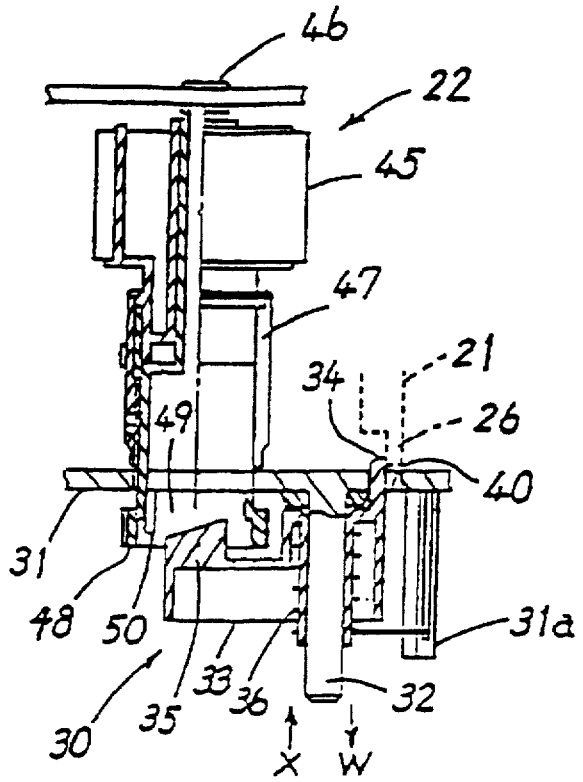
Figure 7B:
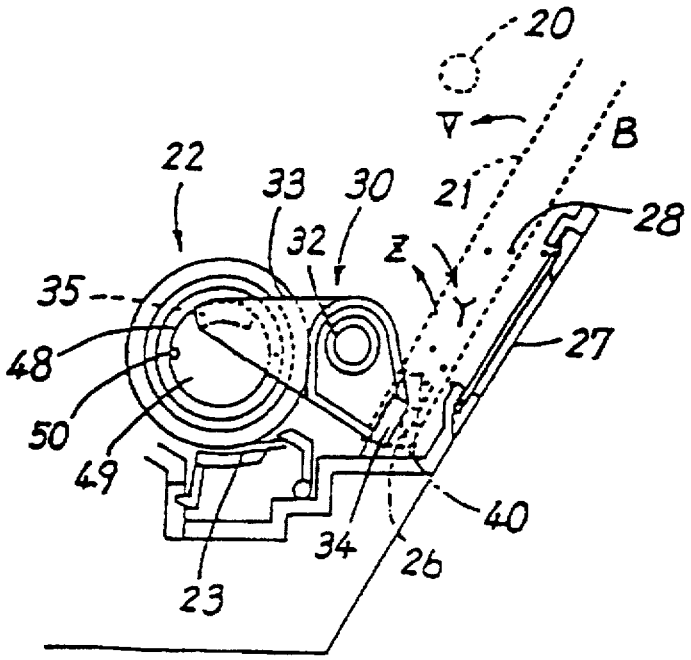

The paper feeding tray 21 can be switched between a paper feeding position A (see FIG. 1(B)) where the paper feeding tray 21 is close to the paper feeding roller 22 and presses the paper onto the paper feeding roller 22 under a given pressure and a standby position B (see FIG. 7(B)) where the paper feeding tray 21 is distant from the paper feeding roller 22 and enables the supply or replacement of paper. Between the paper feeding tray 21 and a tray receiving portion 27 provided below in the main body 1 of the printer to receive the paper feeding tray 21 is interposed a spring 28 for pushing the tray up, which biases the paper feeding tray 21 in the direction of the paper feeding position A.

There is provided the engaging member 30 to be engaged with the paper feeding tray 21 at the standby position B so as to hold the paper feeding tray 21 at the standby position B. A supporting shaft 32 integrally formed with a frame 31 (corresponding to the main body of the paper feeding apparatus) of the main body 1 of the printer is inserted through the engaging member 30 such that the engaging member 30 can rotate around the supporting shaft 32 and can move in the axial direction. The supporting shaft 32 is formed on the outside of the frame 31 and positioned in the vicinity of the lower end of the paper feeding tray 21 so as to protrude in parallel with the transverse shaft 20. Consequently, the engaging member 30 moves closer to or farther away from the paper feeding tray 21 and the paper feeding roller 22.

As shown in FIGS. 1, 4, 5 and 6, the engaging member 30 consists of a base 33 in which the supporting shaft 32 is inserted into a hole 37 and which presents a substantially triangular configuration in side view, the locking piece 34 integrally formed with the base 33 on one side thereof so as to face the paper feeding tray 21, and a disengaging piece 35 integrally formed with the base 33 on the other side thereof so as to face the paper feeding roller 22. Between a cylindrical portion 33*a* of the base 33 through which the supporting shaft 32 is inserted and a fixed rib 31*a* secured to the outside of the frame 31 is disposed a compression torsion spring 36 placed around the cylindrical portion 33*a*, whereby the engaging member 30 is biased in the direction (Z direction) in which the disengaging piece 35 moves downward in the rotational direction and in the direction (X direction) in which the disengaging piece 35 moves closer to the paper feeding tray 21 or to the paper feeding roller 22 in the axial direction.

The locking piece 34 is designed to move freely in and out of a substantially triangular cutaway hole 40 formed in the frame 31 in the direction of the paper feeding tray 21 (inwardly). In the normal state, the locking piece 34 is protruding through the cutaway hole 40 under a force urged by the compression torsion spring 36, while the locking piece 34 is also held in contact with a lower bevel 40a of the cutaway hole 40.

The locking piece 34 protruding through the cutaway hole 40 is positioned on the rotational track of the paper feeding tray 21 such that the locking piece 34 can be pressed onto the bottom surface of the paper feeding tray 21 and engaged with the projection 26 for engagement. The locking piece 34 is also positioned below the bottom surface of the paper feeding tray 21 with a maximum number of sheets of paper disposed thereon at the paper feeding position A. As shown in FIG. 7A, the amount of protection of the locking piece 34 is set so that the amount of engagement (the amount of meshing) with the projection 26 for engagement of the paper feeding tray 21 at the standby position B is about 1.5 mm. When the locking piece 34 is engaged with the projection 26 for engagement, i.e., when the paper feeding tray 21 is at the standby position B, the locking piece 34 is pushed up by the force urged by the spring 28 for pushing up the tray of the paper feeding tray 21 and pressed onto an upper bevel 40*b* of the cutaway hole 40. The upper bevel 40*b* of the cutaway hole 40 has been formed to provide a clearance of 2 to 3 mm between the paper feeding roller 22 and the paper with a maximum number of sheets of paper being disposed on the paper feeding tray 21. Since it is required to rotate the lower end of the paper feeding tray 21 further downward to a position lower than the standby position B in order to engage the locking piece 34 with the projection 26 for engagement, the space between the lower end of the paper feeding tray 21 and the tray receiving portion 27 is provided with an allowance for the downward rotation (stroke). That surface of the locking piece 34 opposed to the bottom surface of the paper feeding tray 21 has been formed into an inclined surface 34*a* such that, when paper feeding tray 21 is rotated from the paper feeding position A to the standby position B, the locking piece 34 can shift smoothly from the state in which the locking piece 34 is protruding and pressed onto the bottom surface of the paper feeding tray 21 to the state in which the locking piece 34 has withdrawn (the state in which the locking piece 34 has deviated from the rotational track of the paper feeding tray 21).

Here, a description will be given to the paper feeding roller 22 prior to the disengaging piece 35. The paper feeding roller 22 consists of: a plurality of rollers 45 to be pressed onto the uppermost sheet of paper on the paper feeding tray 21 at the paper feeding position A; a roller shaft 46 to which the rollers 45 are secured and which is rotatably supported by the main body 1 of the printer; and a drive gear 48 which is secured to that end of the roller shaft 46 closer to the engaging member 30 via a spring clutch 47 and which serves as a drive transmitting element disposed outside the frame 31. To the roller drive gear 48 is transmitted a driving force generated by a drive motor (not shown) disposed in the main body 1 of the printer.

The roller drive gear 48 is formed into a cylinder formed with a hollow 49 which lessens the thickness of the cylinder. The roller drive gear 48 is integrally formed with a rod-like disengaging element 50 for pressing the disengaging piece 35 away from the paper feeding roller 22, which is located in the vicinity of the circumferential surface of the hollow 49.

The disengaging piece 35 presents an arc configuration in its side view and a substantially triangular configuration in its plan view and is disposed on the hollow 49 of the roller drive gear 48. The lower bevel **40*a* is formed so as to position the disengaging piece 35 at the center of the hollow of the concave portion 49 in the normal state in which the locking piece 34 is pressed onto the lower bevel 40*a* of the cutaway hole 40 under the force urged by the compression torsion spring 36. Consequently, the disengaging piece 35 is not in contact with the disengaging element 50 which rotates with the rotation of the roller drive gear 48 in the normal state. Moreover, the stroke (travel distance) of the disengaging piece 35 in the rotational direction has been determined by the relationship between the locking piece 34 and the upper bevel 40*b* so that, when the locking piece 34 is engaged with the projection 26 for engagement and pressed onto the upper bevel 40*b* of the cutaway hole 40, the disengaging piece 35 moves closer to the circumferential surface of the hollow 49, while maintaining a specified clearance therebetween, and is positioned on the rotational track of the disengaging element 50. On the other hand, the stroke (travel distance) of the disengaging piece 35 in the axial direction resulting from the pressing of the disengaging element 50 has been set at a value which can disengage the locking piece 34 from the projection 26 for engagement, i.e., about 2.5 mm larger than about 1.5 mm, which is the amount of engagement of the locking piece 34 with the projection 26 for engagement. A surface 35*a* of the disengaging piece 35 which contacts with the disengaging element 50** is inclined.

With the setting, the engaging member 30 can be switched among: (a) a normal state (see FIGS. 1 and 4) in which, with the paper feeding tray 21 being at the paper feeding position A, the locking piece 34 is protruding through the cutaway hole 40 under the force urged by the compression torsion spring 36 and pressed onto the lower bevel **40*a*, while the disengaging piece 35 has moved closer to the roller drive gear 48 and is positioned at the center of the hollow 49; (b) a first separated state in which the bottom surface of the paper feeding tray 21 is pressed onto the locking piece 34 and the locking piece 34 has withdrawn, while the disengaging piece 35 has moved away from the roller drive gear 48 and is positioned at the center of the hollow 49; (c) an engaged state (see FIG. 7) in which the locking piece 34 is protruding through the cutaway hole 40 and pressed onto the upper bevel 40*b* and the disengaging piece 35 has moved closer to the roller drive gear 48 and is placed on the rotational track of the disengaging element 50 for engagement, i.e., in which the locking piece 34 is engaged with the projection 26 for engagement and the paper feeding tray 21 is held at the standby position B (see FIG. 7); and (d) a second separated state (see FIG. 8) in which the disengaging piece 35 has moved away from the roller drive gear 48 when pressed by the disengaging element 50 and the locking piece 34 is pressed onto the upper bevel 40*b*, while the locking piece 34 is disengaged from the projection 26** for engagement.

In the foregoing structure, when paper is resupplied onto the paper feeding tray 21 or the paper thereon is replaced, the paper feeding tray 21 is rotated in the V direction shown in FIGS. 1 and 4 by holding the knob 24 of the paper feeding tray 21. Then, the lower end of the paper feeding tray 21 is rotated downward and the paper on the paper feeding tray 22 moves away from the rollers 45 of the paper feeding roller 22. With the bottom surface of the paper feeding tray 21 pressed onto the locking piece 34 of the engaging member 30 in the normal state, the engaging member 30 moves in the axial direction (W direction) against the force urged by the compression torsion spring 36 and the locking piece 34 withdraws, thereby placing the engaging member 30 in the first separated state. When the paper feeding tray 21 is rotated further downward with the cutout portion 25 passing by the locking piece 34, as shown in FIG. 7, the engaging member 30 moves in the axial direction (X direction) under the biasing force of the compression torsion spring 36 and the locking piece 34 protrudes, so that the projection 26 for engagement, which has been biased upwardly by the spring 28 for pushing up the tray, pushes up the locking piece 34 and is engaged therewith. The pushing force rotates the engaging member 30 around the supporting shaft 32 (Y direction) and the disengaging piece 35 moves upwardly to a position above the hollow 49 of the roller drive gear 48 and is placed on the rotational track of the disengaging element 50, thereby placing the engaging member 30 in the engaged position and holding the paper feeding tray 21 at the standby position B.

Figure 9A:
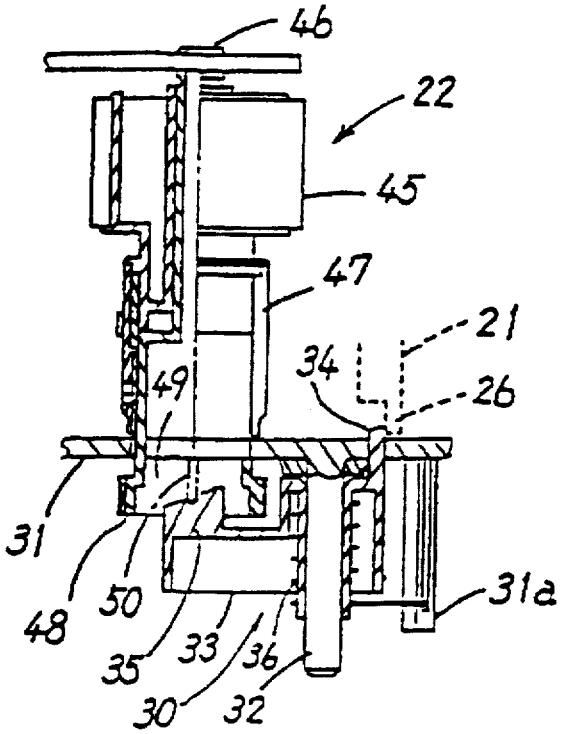
Figure 9B:
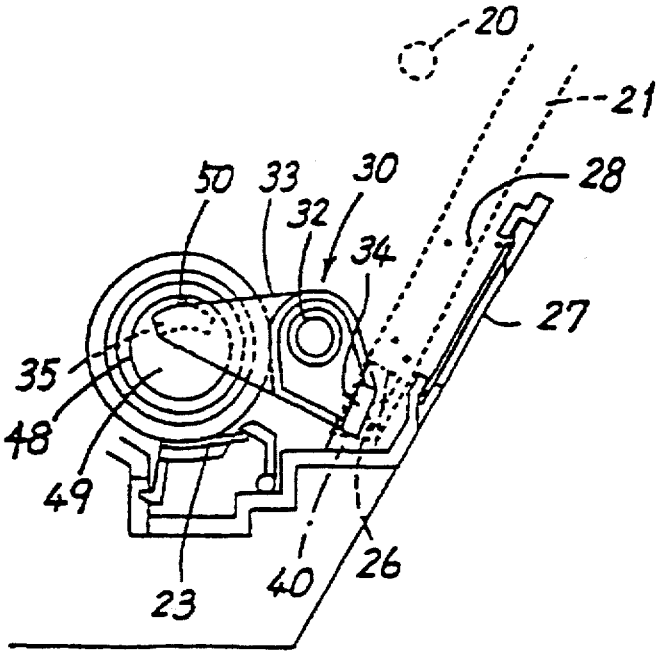
Figure 10:
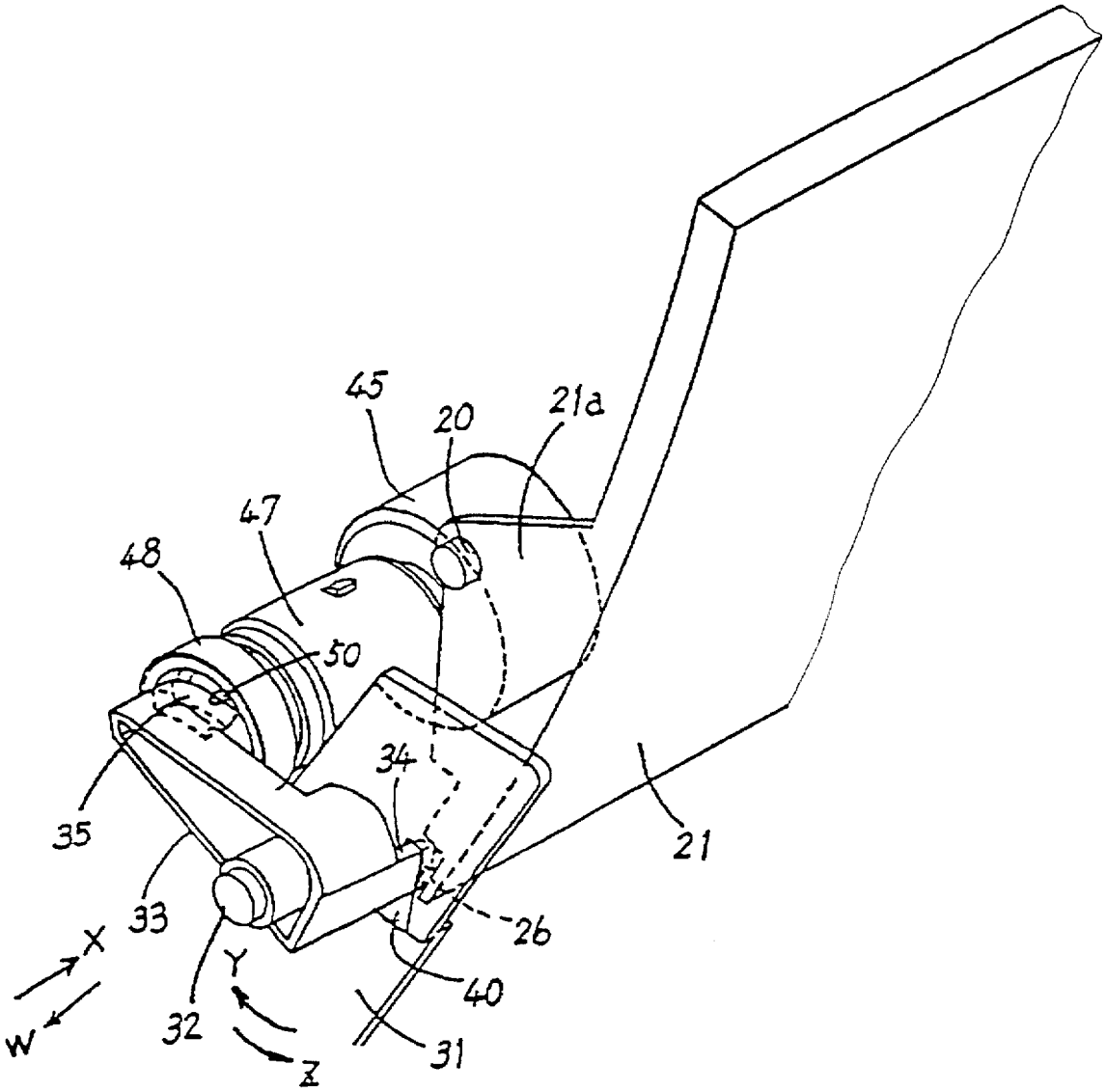
FIG. 10 is a perspective view of the principal portion of the paper feeding apparatus with the engaging member rotating around the shaft and with the disengaging piece pressed onto the disengaging element.

With the disengaging element 50 positioned above the hollow 49, i.e., on the travel path of the disengaging piece 35, when the engaging member 30 is placed in the engaged position, as shown in FIGS. 9 and 10, the disengaging piece 35 is pressed onto the disengaging element 50. However, the paper feeding tray 21 remains held at the standby position B without being interfered with, except that the paper feeding tray 21 at the standby position B is slightly lowered in level by the disengaging element 50.

After supplying paper onto the paper feeding tray 21 held at the standby position B or replacing the paper thereon, the driving force of the drive motor (not shown) is transmitted to the roller drive gear 48 of the paper feeding roller 22 via a gear or the like, in response to a printing start instruction, so that the roller drive gear 48 is rotated. At this point, the spring clutch 47 is turned OFF, so that the driving force is not transmitted to the roller shaft 46 and the rollers 45 are not rotating.

Figure 8A:
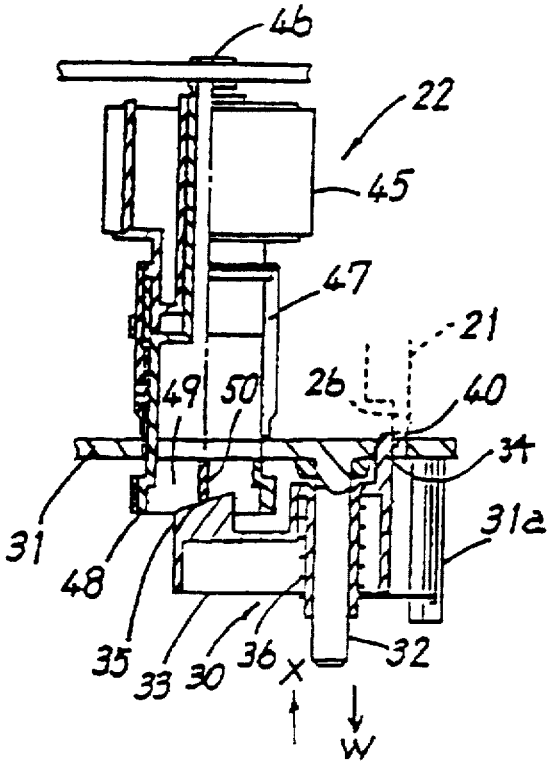
Figure 8B:
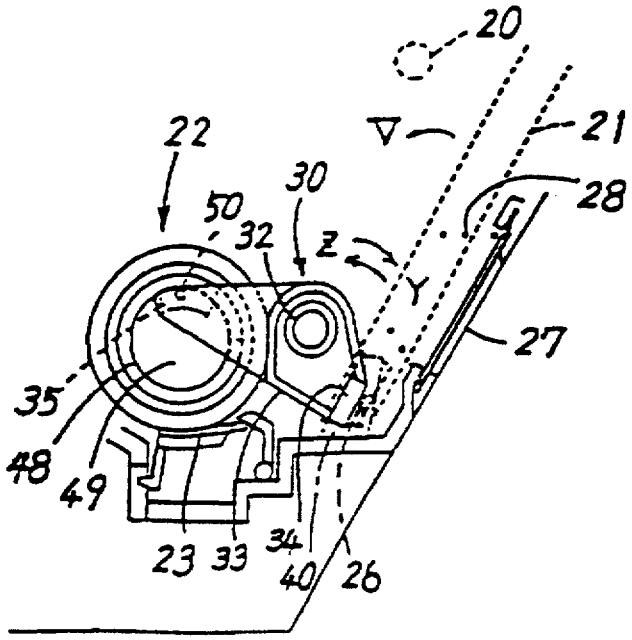

When the roller drive gear 48 is rotated, the disengaging element 50 of the hollow 49 rotates accordingly. With the disengaging element 50 pressed onto the disengaging piece 35 as shown in FIG. 8, the engaging member 30 moves in the axial direction (W direction) against the force urged by the compression torsion spring 36, which causes the locking piece 34 to withdraw and places the engaging member 30 in the second separated state. Then, the locking piece 34 is disengaged from the projection 26 for engagement of the paper feeding tray 21 and the lower end of the paper feeding tray 21 is pushed upwardly by the force urged by the spring 28 for pushing up the tray, which returns the paper feeding tray 21 to the paper feeding position A, so that the paper on the paper feeding tray 21 is pressed onto the rollers 45 of the paper feeding roller 22. When released from the pressing by the disengaging element 50 and from the pushing up by the paper feeding tray 21, the engaging member 30 rotates around the supporting shaft 32 (Z direction) under the force urged by the compression torsion spring 36 and moves in the axial direction (X direction), thereby returning to the normal position. When the disengaging piece 35 is pressed onto the disengaging element 50 (as shown in FIGS. 9 and 10) with the engaging member 30 in the engaged state, the disengaging element 50 presses the disengaging piece 35 after making one rotation. In view of the foregoing, it is desirable that only the roller drive gear 48 is caused to make 1.5 or more previous rotations in order to ensure disengagement.

When the previous rotations of only the roller drive gear 48 was completed, the spring clutch 47 is turned ON in response to an instruction from the printer so as to transmit the driving force of the drive motor to the roller shaft 46, thereby rotating the rollers 45 and feeding paper from the paper feeding tray 21.

Thus, after supplying paper onto the paper feeding tray 21 or replacing the paper thereon, the engaging member 30 in the engaged state is automatically placed in the separated state by the rotation of the roller drive gear 48 of the paper feeding roller 22, thereby disengaging the engaging member 30 from the paper feeding tray 21 and pressing the paper from the paper feeding tray 21 onto the rollers 45 of the paper feeding roller 22. Accordingly, a user is relieved of the trouble of pressing the paper onto the paper feeding roller after the operation of supplying or replacing paper and hence a protecting mechanism is not required any more, thereby achieving an excellent operability compared with the case where the lever or the like is manually operated, resulting in a reduced component count, a miniaturized apparatus, and lower cost.

Moreover, since the disengaging piece 35 is positioned at the center of the hollow 49 of the roller drive gear 48 and on the rotational track of the disengaging element 50 with the engaging member 30 in the normal state and in the engaged state, respectively, the disengaging member 50 rotating with the rotation of the paper feeding roller 22 is not pressed onto the disengaging piece 35 in feeding paper with the engaging member 30 in the normal state and with the paper feeding tray 21 at the paper feeding position A. Consequently, the influence (a loss in torque etc.) exerted on the drive motor for driving the paper feeding roller 22 is negligible compared with the conventional mechanism in which the paper on the paper feeding tray is automatically pressed onto the paper feeding roller and separated, thereby preventing noises or the like resulting from a collision of the disengaging piece 35 with the disengaging element 50 in feeding paper and the abrasion thereof.

The engaging member 30 is a single member composed of the locking piece 34 corresponding to the projection 26 for engagement on the side of the paper feeding tray 21 and the disengaging piece 35 corresponding to the disengaging element 50 on the side of the paper feeding roller 22, which are integrally formed. The automatic disengaging (lock disengaging) mechanism of the paper feeding tray 21 can be composed of a simple mechanical structure, resulting in a reduced component count, lower cost, and apparatus miniaturization. In addition, since the force urged by the spring 28 for pushing up the tray for urging the paper feeding tray 21 in the direction of the paper feeding position A has also been used to switch the position of the engaging member 30, there can be implemented a further simplified structure and a further reduced component count.

Moreover, even with the disengaging piece 35 pressed onto the disengaging element 50 when the engaging member 30 is placed in the engaged state, the paper feeding tray 21 can be held at the standby position B. Therefore, there is no peculiar point at which the paper cannot be separated from the rollers 45 of the paper feeding roller 22, which eliminates the necessity for the conventional positioning control, so that the pressing and separation of the paper onto and from the rollers 45 of the paper feeding roller 22 can be surely performed.

Furthermore, since the disengaging piece 35 and the disengaging element 50 are disposed in the hollow 49 of the roller drive gear 48, the necessary space on a side of the paper feeding roller 22 can be saved, which enables the miniaturization of the apparatus.

It will be appreciated that the invention is not limited to the foregoing embodiments and various other changes and modifications as fall within the scope of the invention may be made with respect to the foregoing embodiments. For example, it is also possible to provide a plurality of disengaging members 50 in the hollows 49 of the roller drive gear 48 provided that the operation of disengaging the paper feeding tray 21 is not interfered with, thereby reducing the time period required by the previous rotations of the roller drive gear 48. It is also possible to form the disengaging element 50 in a hollow of a pulley for drive transmission provided on an end of the roller shaft 46, instead of forming the disengaging element 50 in the hollow 49 of the roller drive gear 48. Alternatively, it is also possible to remove the spring clutch 47 from the paper feeding roller 22 so as to omit the previous rotations of the roller drive gear 48, thereby performing the operation of disengaging the paper feeding tray 21 with the rotation of the paper feeding roller 22 at the initiation of feeding paper. In this case, it is necessary to convey the fed paper in synchronization with the operation of image formation by means of a timing roller or the like provided downstream of the paper feeding roller 22.

It is also possible to provide the engaging member 30 which is movable only in the axial direction and an additional member for holding the locking piece 34 at a withdrawn position (with the engaging member 30 separated from the paper feeding roller 22 and from the paper feeding tray 21 against the force urged by the compression torsion spring 36) so that, when the locking piece 34 has withdrawn, the disengaging piece 35 is positioned away from the gear 48 and deviated from the track of the disengaging element 50 and that, when the locking piece 34 is protruding, the disengaging piece 35 is positioned close to the gear 48 and on the track of the disengaging element 50. In this case, when the foregoing element is pushed away by the rotation of the paper feeding tray 21 in the direction of the standby position B, the engaging member 30 moves in the axial direction under the force urged by the compression torsion spring 36 and the locking piece 34 protrudes, thereby holding the paper feeding tray 21 at the standby position B, while the disengaging piece 35 moves closer to the gear 48 and is positioned on the track of the disengaging element 50. When the gear 48 rotates, the disengaging element 50 presses the disengaging piece 35 in the axial direction so as to cause the locking piece 34 to withdraw, the paper feeding tray 21 rotates from the standby position B to the paper feeding position A, and the foregoing element holds the locking piece 34 at the withdrawn position.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A paper feeding apparatus comprising:

a paper feeding tray rotatably movable around a shaft;

a paper feeding roller including a drive;

the paper feeding tray located between a paper feeding position where the paper feeding tray is close to the paper feeding roller and presses paper onto the paper feeding roller and a standby position where the paper feeding tray is away from the paper feeding roller and supply or replacement of paper is accomplished; and an engaging member shiftable between an engaged state and a separated state by operation of the drive of the paper feeding roller;

the engaged state being a state where the engaging member is engaged with the paper feeding tray and in contact with paper feeding roller, so that the paper feeding tray is held at the standby position;

the separated state being a state where the engaging member moves away from the paper feeding tray so that the engaging member is disengaged from the paper tray.

2. The paper feeding apparatus of claim 1, wherein the paper feeding roller has an axis and the engaging member is in contact with and rotatable around a supporting shaft mounted in a main body of the paper feeding apparatus and movable in a direction of the axis of the paper feeding roller, a locking piece located adjacent to the paper feeding tray is formed on one side of the engaging member, a disengaging piece located adjacent to the paper feeding roller is formed on the other side of the engaging member, the paper feeding roller is provided with a disengaging element which presses the disengaging piece in the direction of the axis to place the engaging member in the separated state, and the paper feeding tray presses the locking piece in a rotational direction in the engaged state of the engaging member, thereby holding the disengaging piece at a position where the disengaging piece contacts the disengaging element.

3. The paper feeding apparatus of claim 2, wherein a concave portion is formed on the outer surface of a drive transmitting element provided on an end of a roller shaft of the paper feeding roller, and the disengaging piece of the engaging member and the disengaging element of the paper feeding roller upon contact with each other are located in the concave portion of the drive transmitting element.

4. A paper feeding apparatus comprising:

a paper feeding tray rotatably movable around a shaft;

a paper feeding roller having an axis and a drive;

he feeding tray located between a paper feeding position where the paper feeding tray is close to the paper feeding roller and presses paper onto the paper feeding roller and a standby position where the paper feeding tray is located away from the paper feeding roller and supply or replacement of paper is accomplished, an engaging member shiftable by the drive of the paper feeding roller between an engaged state where the engaging member is engaged with the paper feeding tray so as to hold the paper feeding tray at the standby position and a separated state where the engaging member moves away from the paper feeding tray so as to be disengaged from the paper feeding tray, a spring for urging the paper feeding tray from the standby position to a direction of the paper feeding position.

5. The paper feeding apparatus of claim 4, further comprising:

a supporting member located parallel to the axis of the paper feeding roller and located in a periphery of one end of the paper feeding roller for supporting the engaging member so that the engaging member is rotatably and movable in the axial direction of the paper feeding roller, and a disengaging element which is located on a surface of one end of the paper feeding roller in the periphery of a circumference of the surface, wherein the engaging member includes a locking piece located adjacent to the paper feeding tray and a disengaging piece located adjacent to the disengaging element, the paper feeding tray contacts and presses the locking piece in a rotational direction in the engaged state of the engaging member, thereby holding the disengaging piece at a position where the disengaging piece contacts with the disengaging element, and the disengaging element presses the disengaging piece in a direction of the axis of the paper feeding roller by the rotation of the paper feeding roller to position the engaging member into the separated state.

6. The paper feeding apparatus of claim 5, further comprising:

a drive transferring element for transferring a drive force from a drive source to the paper feeding roller, the drive source is located in a shaft of the paper feeding roller at one end of the paper feeding roller, wherein the drive transferring element includes on the outer surface of the paper feeding roller in a direction of the axis and a concave portion, in which the disengaging element and the disengaging piece of the engaging member are located.

7. A paper feeding apparatus including a paper feeding tray rotatably movable around a shaft between a paper feeding position where the paper feeding tray is close to a paper feeding roller which has an axis and presses paper onto the paper feeding roller and a standby position where the paper feeding tray is located away from the paper feeding roller and supply or replacement of paper is accomplished, the paper feeding apparatus comprising:

a first spring for urging the paper feeding tray from the standby position to a direction of the paper feeding position;

an engaging member for engaging with the paper feeding tray to hold the paper feeding tray at the standby position;

a supporting member rotatably supporting the engaging member so that the engaging member is rotatable and movable in a direction of the axis of the paper feeding roller, a disengaging element which is located on a surface of one end of the paper feeding roller;

a second spring for urging the engaging member to a direction of closing with the paper feeding roller and the paper feeding tray and to a direction of rotating against pressing force by the paper feeding tray in the standby position; and a control member with a hole for controlling a range of rotation of the engaging member, wherein the engaging member includes a locking piece located adjacent to the paper feeding tray and a disengaging piece located adjacent to the disengaging element, the locking piece being insertable into the hole in the control member, the range of rotation of the engaging member is controlled and limited by the contact of the locking piece with the inner surface of the hole, a shape of the hole is of a form so that the engaging member can be held in a normal state which is a state the disengaging piece is positioned in the proximity of the axis of the paper feeding roller when the paper feeding tray is placed at the paper feeding position and in an engaged state which is a state the disengaging piece is placed on the rotational track of the disengaging element when the paper feeding tray at the standby position is engaged with the locking piece, and the engaging member being shifted from the normal state to the engaged state by the locking piece being pressed toward the axial direction by rotating the paper feeding tray against the spring urge from the paper feeding position to the direction of the standby position, and is shifted from the engaged state to the normal state by the disengaging piece being pressed toward a direction of the axis by the rotation of the disengaging element caused by the rotation of the paper feeding roller.

* * * * *